United States Patent [19]

Poiencot

[11] Patent Number: 4,621,563

[45] Date of Patent: Nov. 11, 1986

[54] APPARATUS FOR ALIGNING GUN SIGHTS

[75] Inventor: Mark D. Poiencot, Houma, La.

[73] Assignee: Sure Shot of Louisiana, Inc., Houma, La.

[21] Appl. No.: 668,087

[22] Filed: Nov. 5, 1984

[51] Int. Cl.[4] ..... F41F 25/00

[52] U.S. Cl. ..... 89/37.04; 73/167

[58] Field of Search ..... 89/37.03, 37.04, 37.09, 89/37.14, 40.06; 42/94; 73/167; 211/64

[56] References Cited

U.S. PATENT DOCUMENTS

| | | | |
|---|---|---|---|
| 882,988 | 3/1908 | Aloyos et al. | 89/41.01 |
| 2,582,140 | 1/1952 | Leek | 89/37.04 |
| 2,731,829 | 1/1956 | Wigington et al. | 89/37.04 |
| 3,361,265 | 1/1968 | Wernimont | 42/94 |
| 4,333,385 | 6/1982 | Culver | 73/167 |
| 4,409,826 | 10/1983 | Wenger | 73/167 |

FOREIGN PATENT DOCUMENTS

| | | | |
|---|---|---|---|
| 574221 | 12/1945 | United Kingdom | 89/37.04 |

*Primary Examiner*—Stephen C. Bentley
*Assistant Examiner*—Stephen Johnson
*Attorney, Agent, or Firm*—Keaty & Keaty

[57] ABSTRACT

An apparatus is disclosed for aligning gun sights wherein the rifle is mounted on a gun-receiving member that pivots relative to a fixed base. A spring is fixed between the gun-receiving member and base for absorbing both the horizontal and vertical components of the recoil of the gun when it is fired, the spring being positioned on the side of the pivot adjacent the butt-receiving end of the gun-receiving member. An internally threaded hole is provided through the gun-receiving member on the side of the pivot opposite the spring, and an externally threaded rod, which is rotatably mounted to the base, is disposed through the aperture for selectively tilting the gun-receiving member relative to the base to help align the gun sight with a target. Once the gun sight and target are aligned, the gun is fired and the recoil is absorbed by the spring as the gun-receiving member pivots relative to the base. The gun sight can afterwards be pointed directly at the hole made by the bullet that was fired, and the sight and line of fire of the gun barrel will be pointed in the same direction. Precise alignment of the sight and gun barrel is possible because of the efficient absorption of the gun's recoil by the spring and pivot mechanism.

2 Claims, 4 Drawing Figures

APPARATUS FOR ALIGNING GUN SIGHTS

BACKGROUND OF THE INVENTION

1. Field of the Invention

This invention concerns as apparatus for adjusting the sights of a gun, and more particularly an apparatus for adjusting the telescopic sight on a rifle.

2. General Discussion of the Background of the Invention

A problem frequently encountered by hunters, marksmen and users of firearms is that telescopic sights on the firearms move out of alignment with the axis of the rifle barrel. Once this happens a hunter's or marksman's aim is seriously affected since the gun will not point at the target shown in the gun sight. As a result, even the most careful marksman will miss his target since the bullet will not travel in the anticipated direction.

An apparatus for realigning gun sights was proposed in U.S. Pat. No. 4,333,385 in which a gun support was slidably supported upon a base so tht the recoil of the gun could be absorbed by the sliding movement of the rifle relative to the base. A rifle can be fixed in the gun support with the telescopic sight pointed at the bull's-eye of a target. When the gun is fired, the bullet will travel in the direction that the rifle barrel is pointed, thereby missing the bull's-eye if the sight and barrel are out alignment. The telescopic sight can then be pointed to the hole made by the bullet to realign the telescopic sight with the true direction of the rifle barrel. The problem with this device is that the sliding movement of the gun support relative to the base only absorbs the horizontal component of the recoil of the gun. In reality there are vertical and horizontal components of recoil, and the imperfect absorption of recoil gives rise to small movements of the apparatus which make it impossible to accurately realign the gun sight.

It is accordingly an object of this invention to provide an apparatus for aligning gun sights which absorbs both the horizontal and vertical components of the recoil of the gun.

It is a further object of this invention to provide a lightweight yet durable and portable apparatus which can be easily used outdoors.

SUMMARY OF THE INVENTION

The aforementioned objects are achieved by providing an apparatus for aligning gun sights which comprises an elongated, rectangular base having a pair of parallel uprights fixed to the base. The uprights carry a horizontal, rotatable pivot pin between them in such a fashion that the pin rotates about its longitudinal axis. An elongated, rectangular gun-receiving member, which is similar in size and shape to the base, is carried by the pin for pivotal movement relative to the base. The gun receiving member is provided with a butt-receiving end and a barrel-receiving end, the butt-receiving end being provided with clamps for securing the butt of a gun to the butt-receiving end, and the barrel-receiving end being provided with clamps for securing the barrel of the gun to the barrel-receiving end.

A spring is fixed between the base and gun-receiving member for absorbing both the vertical and horizontal components of recoil of the gun whcn it is fired. The spring is positioned between the horizontal pivot pin and butt-receiving end of the gun-receiving member so that the recoil of the gun is absorbed as the force of the recoil is transmitted against the butt-receiving end of the gun-receiving member. This recoil force creates torque about the pivot which is transmitted to the spring.

An internally threaded opening is placed through the gun-receiving member adjacent its barrel-receiving end. An externally threaded rod is rotatably mounted to the base for rotation about the longitudinal axis of the threaded rod, and this rod is threaded through the opening so that the external threads of the rod mate with the internal threads of the opening. A knob is fixed to the rod for rotating the rod, and rotation of the rod tilts the gun-receiving member about the pivot pin to help align the telescopic sight of the gun with the target even if the apparatus is not on the same level as the target.

DETAILED DESCRIPTION OF THE PREFERRED EMBODIMENT

Figure 1:
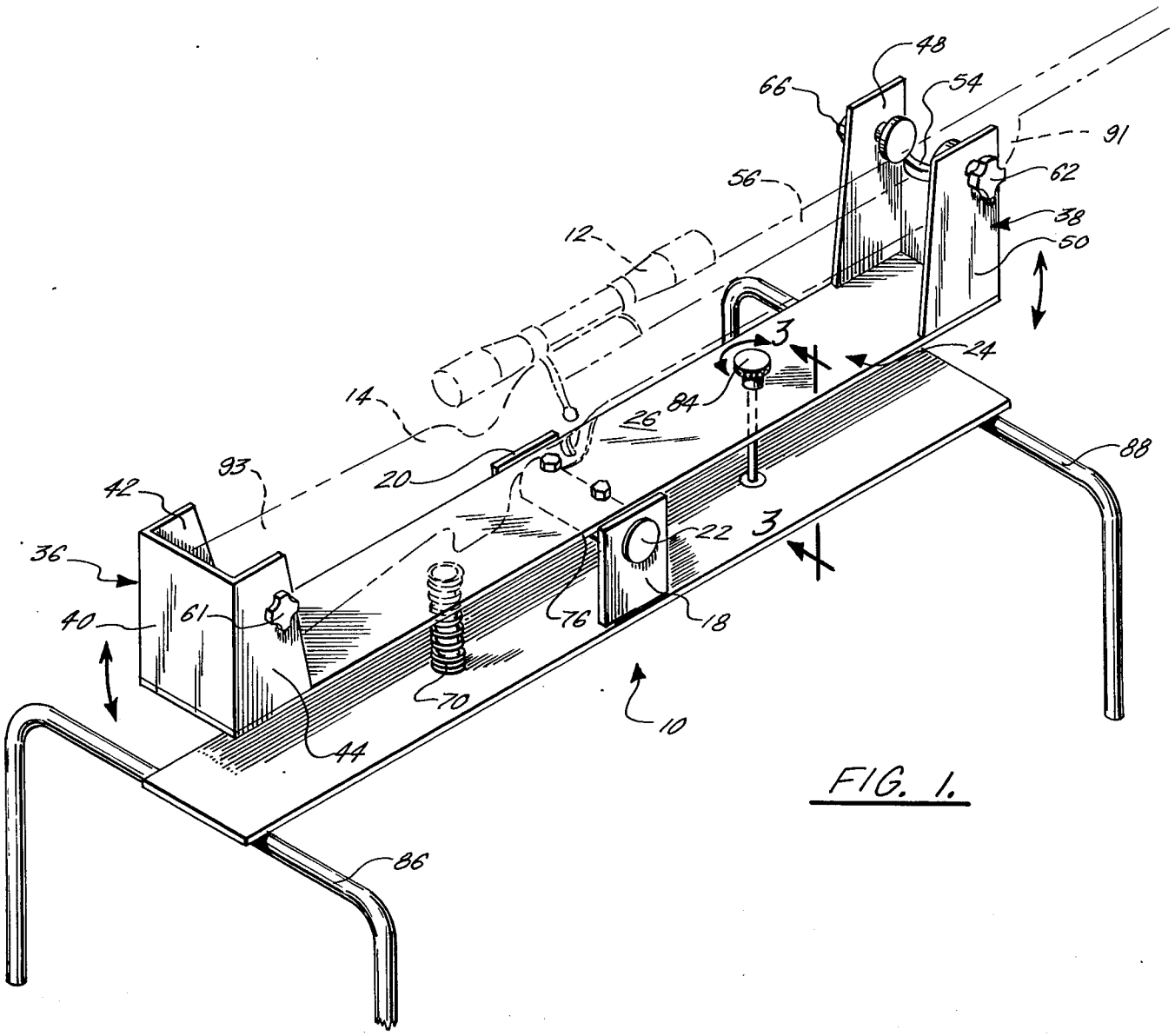
FIG. 1 is perspective view of the apparatus for aligning gun sights, portions of the apparatus and a rifle fixed therein being shown in phantom.
Figure 2:
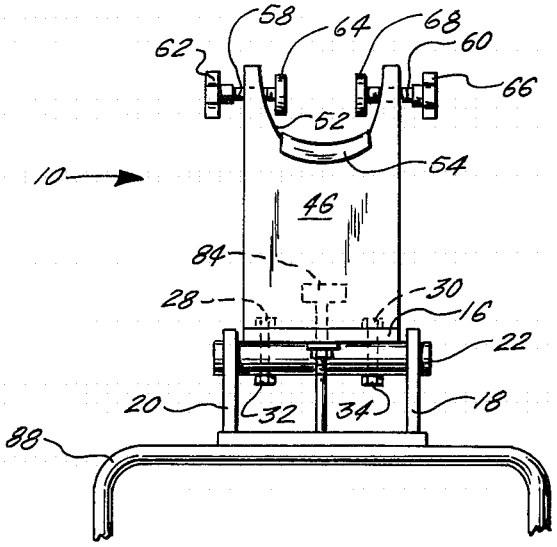
FIG. 2 is a front view of the apparatus shown in FIG. 1.
Figure 3:
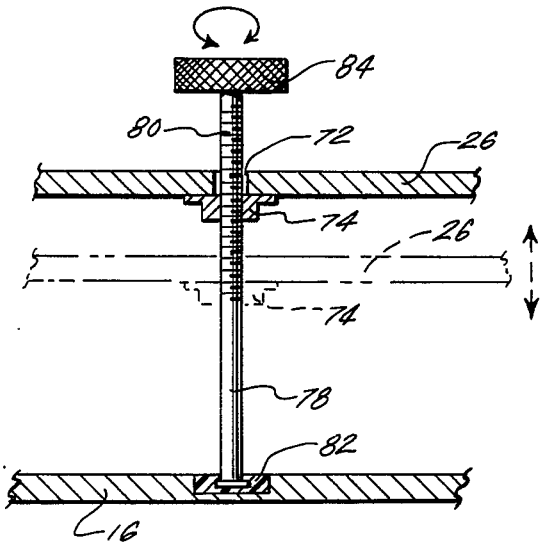
FIG. 3 is a view taken along section line 3—3 in FIG. 1, the adjustable height of the member being illustrated by phantom lines showing the gun-receiving member in a lowered position.
Figure 4:
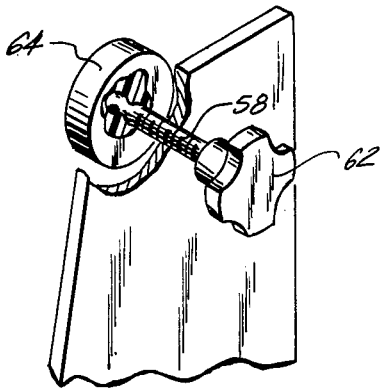
FIG. 4 is an enlarged view of the means for securing the rifle or gun to the gun-receiving member, portions of the wall of the barrel-receiving cradle being broken away for clarity.

FIGS. 1 and 2 show an apparatus 10 for aligning gun sight 12 of a gun, such as rifle 14. Apparatus 10 comprises an elongated, rectangular base 16 made of aluminum, steel, iron or any other material which provides a heavy base that resists movement. A pair of parallel uprights 18, 20 are fixed to base 16 at about the transverse midline of rectangular base 16, uprights 18, 20 being in the nature of flat metal members securely welded to base 16 and being provided with opposing, complementary circular openings. A horizontal, rotatable, cylindrical pivot pin 22 is carried between the uprights by placement of pin 22 through the openings in uprights 18, 20. Placement of pin 22 in this manner permits it to rotate about its longitudinal axis, the dimensions of the pin and hole being close enough to provide smooth rotation of the pin with virtually no free play.

A gun-receiving member 24 is comprised of a rectangular plate 26 having the same dimensions as base 16 and being placed in substantially parallel relationship above base 16. Member 24 is fixed to and carried by pin 22 for pivotal movement relative to base 16, member 24 being fixed to pin 22 by means of bolts 28, 30 which are placed through a cylindrical hole in pin 22 and secured in place with nuts 32, 34. Member 24 is further provided with a butt-receiving end 36 and a barrel-receiving end 38. The butt-receiving and 36 is comprised of a channel iron, U-shaped cradle which is comprised of a back wall 40 and side walls 42, 44 which are trapezoidally-shaped to provide a cradle into which the butt of rifle 14 is received. The edge of each wall 42, 44 which faces toward rifle 14 is slanted so as to be wider at its bottom than at its top.

Barrel-receiving end 38 is comprised of a front wall 46 (FIG. 2) and side walls 48, 50. Each of side walls 48, 50 is trapezoidally-shaped, one being the mirror image of the other to provide, in cooperation with front wall 46, a barrel-receiving cradle. The rearward facing edge of each of side walls 48, 50 is slanted so that the base of each sidewall is longer than the top edge. Front wall 46 is provided with an arcuate, U-shaped depression 52 having a cushion 54 adhered thereto for providing a surface with a high coefficient of friction against which the forearm 91 of gun 14 can ride without damaging the barrel.

Barrel-receiving end 38 is provided with a pair of opposing, parallel, internally threaded openings in each of side walls 48, 50. A threaded screw 58, 60 is placed through each of the internally threaded openings in mating engagement with the internal threads of the openings. Screw 58 is provided with knob 62 and rifle engaging member 64. Screw 60 is similarly provided with a knob 66 and rifle engaging member 68. Members 64, 68 are cylindrical elements having a relatively high coefficient of friction while knobs 62, 66 are relatively flat members each having four arcuate depressions therein into which an operator's fingers may fit.

Butt-receiving end 36 is similarly provided with a pair of opposing, parallel, internally threaded openings through side wall 42, 44. Screws similar to 58, 60 are placed through these apertures with gun engaging members on the interior of the cradle and knobs with arcuate openings on the outside for rotating the screws and advancing the member inwardly against the butt of the gun. Only one of these knobs 61 is shown in FIG. 1, but their general construction is similar enough to that of the screws and knobs on the barrel-receiving portion that their operation will be readily understood.

A spring 70 (FIG. 1) is fixed between base 16 and plate 26 of gun-receiving member 24. Spring 70 is positioned on the side of pin 22 more adjacent butt-receiving end 36 of member 24. Spring 70 is held in place by having a first end placed in a cylindrical depression (not shown) on the top face of base 16, while the second end of spring 70 is placed in a corresponding, opposed depression (not shown) on the bottom face of plate 26. The spring is chosen such that it has a spring constant suitable for absorbing the recoil of rifle 14 when it is fired while the rifle is held in place by gun-receiving member 24.

Means is also provided for tilting member 24 about pin 22 to assist in adjustment of the height of barrel 56 of rifle 14 when aiming at a target. This adjustment means comprises a hole 72 through plate 26 and an adjacent, internally threaded flange nut 74 in place immediately beneath hole 72, the internally threaded opening of nut 74 being coaxially aligned with hole 72. The position of hole 72 and flange nut 74 is along the longitudinal axis of rectangular plate 24 between barrel-receiving end 38 and a portion 76 of member 26 which pivots over pin 22.

A rod 78 is provided having external threads 80 over about half its length. Rod 78 is rotatably mounted to base 16 with a nylon bushing 82 which permits rod 78 to rotate about its longitudinal axis. Rod 78 is placed through hole 72 and flange nut 74 so that external threads 80 of rod 78 mate with the internal threads of nut 74.

A knurled, cylindrical knob 84 is fixed to rod 78 above plate 26. The knurls on knob 84 provide traction so that a person can turn the knob and connected rod 78.

In the embodiment shown in FIGS. 1 and 2, base 16 is mounted on a pair of opposing, parallel, U-shaped legs 86, 88. These legs can be secured to base 16 by any conventional fashion, such as welding or bolting. In especially preferred embodiments of the invention, the legs are bolted to base 16, thereby providing the ability to interchange legs of varying heights to adjust the apparatus to fire at targets of different heights. Bolts would also permit base 26 to be secured to any already existing flat surface, such as a concrete or wooden bench.

In operation, apparatus 10 is placed in front of a target at about the height of the target. Rifle 14 is then placed in gun-receiving member 24 in the fashion shown in phantom in FIG. 1. The butt of rifle 14 is placed into the cradle formed by butt-receiving end 36 while forearm 91 is placed in depression 52 on top of cushion 54 of barrel-receiving end 38. Knobs 62, 66, 61, and the knob which opposes knob 61 (not shown) are then rotated to advance the attached rifle engaging members towards the portion of the gun in each of the respective cradles. The members at the barrel-receiving end 38 engage the wooden forearm 91 of rifle 14 while the rifle engaging members at the butt-receiving end 36 engage the butt 93. Once the gun is firmly held in place, knob 84 can be rotated to tilt plate 26 which raises or lowers barrel 56 of rifle 14. Using knob 84, a marksman can then align the cross hairs in telescopic sight 12 with a target, for example, the bull's-eye of a conventional circular target.

Once telescopic sight 12 is pointed towards the intended target, the trigger of rifle 14 is pulled and a shot is fired at the target. If sight 12 and barrel 56 are not perfectly aligned, the bullet which is fired will miss the target at which the marksman had aimed. The recoil from the gun, which has both horizontal and vertical components, will be absorbed by spring 70 as member 24 pivots back and forth about the axis of pin 22. Efficient absorption of recoil by spring 70 prevents movement of apparatus 10.

Once the shot has been fired and the recoil absorbed without movement of apparatus 10, sight 12 can then be loosened and realigned so that it is aimed at the hole made by the bullet that was fired. Once sight 12 is aligned in this way, it is aimed in precisely the same direction as barrel 56. The sight can be tightened in place by the conventional means provided on rifles.

An optional test shot can be made in which another shot is fired, the recoil absorbed by the gun, and the bullet's point of impact viewed through sight 12. If sight 12 is correctly aligned, a hole will be made by the bullet at the place indicated through sight 12.

Although this specific embodiment of the invention has been described in accordance with the requirements of law, the intended scope of the invention is limited only by the following claims.

I claim:

1. An apparatus for aligning gun sights, comprising:

an elongated base;

a pair of parallel uprights fixed to the elongated base and carrying a horizontal, rotatable pivot pin therebetween, said horizontal, rotatable pivot pin being rotatable about its longitudinal axis;

a gun-receiving member carried by said horizontal, rotatable pivot pin for pivotal movement relative to said elongated base, said gun-receiving member having a butt-receiving end and a forearm-receiving end;

means for securing the butt of a gun to said butt-receiving end;

means for securing the forearm of said gun to said forearm-receiving end;

means for tilting said gun-receiving member, relative to said elongated base, about said horizontal, rotatable pivot pin to an adjusted position for aligning the gun sight of said gun with a target, said means for tilting said gun-receiving member being positioned intermediate an end of said gun-receiving member and said horizontal, rotatable pivot pin; and a spring fixed between the elongated base and said gun-receiving member for absorbing the recoil of said gun when said gun is fired, and for returning said gun-receiving member to said adjusted position.

2. An apparatus for aligning gun sights, comprising:

an elongated base;

a pair of parallel uprights fixed to the elongated base and carrying a horizontal, rotatable pivot pin therebetween, the horizontal, rotatable pivot pin rotating about its longitudinal axis;

a gun-receiving member carried by the horizontal, rotatable pivot pin for pivotal movement relative to the elongated base, the gun-receiving member having a butt-receiving end and a forearm-receiving end, the butt-receiving end being provided with means for securing the butt of a gun to the butt-receiving end, the forearm-receiving end being provided with means for securing the forearm of said gun to the forearm-receiving end;

a spring fixed between the elongated base and the gun-receiving member for absorbing the recoil of the gun when the gun is fired, the spring being positioned intermediate the horizontal pin and said butt-receiving end of said gun-receiving member;

an opening through said gun-receiving member intermediate the forearm-receiving end and a portion of said gun-receiving member which pivots over said horizontal, rotatable pivot pin;

an externally threaded rod rotatably mounted to said elongated base for rotation about the longitudinal axis of said externally threaded rod, the external threads of said externally threaded rod mating with internal threads of a flange nut disposed below said opening; and a knob fixed to said externally threaded rod for rotating said externally threaded rod, rotation of said externally threaded rod tilting said gun-receiving member relative to said elongated base about said horizontal rotatable pivot pin and aligning the gun sight of said gun with a target.

* * * * *